US009926117B2

(12) United States Patent
Lee

(10) Patent No.: US 9,926,117 B2
(45) Date of Patent: Mar. 27, 2018

(54) QUADRUPLE SEALING STRUCTURE FOR CAN COVER

(71) Applicant: Su-ho Lee, Gwacheon (KR)

(72) Inventor: Su-ho Lee, Gwacheon (KR)

( * ) Notice: Subject to any disclaimer, the term of this patent is extended or adjusted under 35 U.S.C. 154(b) by 252 days.

(21) Appl. No.: 14/940,362

(22) Filed: Nov. 13, 2015

(65) Prior Publication Data

US 2016/0130051 A1 May 12, 2016

(30) Foreign Application Priority Data

Jan. 7, 2014 (KR) ..... 10-2014-0002071
Sep. 29, 2014 (WO) ..... PCT/KR2014/009085

(51) Int. Cl.
*B65D 53/02* (2006.01)
*B65D 51/00* (2006.01)
*B65D 17/00* (2006.01)

(52) U.S. Cl.
CPC ..... *B65D 51/007* (2013.01); *B65D 17/165* (2013.01); *B65D 53/02* (2013.01); *B65D 2517/0041* (2013.01); *B65D 2517/0098* (2013.01)

(58) Field of Classification Search
CPC .... B65D 51/007; B65D 53/02; B65D 17/165; B65D 2517/0098; B65D 2517/0041
USPC ..... 220/233–238, 378, 319, 320
See application file for complete search history.

(56) References Cited

U.S. PATENT DOCUMENTS 3,642,166 A * 2/1972 Starr ..... B65D 43/0222 217/89
3,886,047 A * 5/1975 Billups, Jr. ..... C12M 23/10 220/319
4,625,890 A * 12/1986 Galer ..... B65D 45/327 220/319
5,176,278 A * 1/1993 Quarberg ..... B65D 51/007 220/258.2
5,240,132 A * 8/1993 Tucker ..... B65D 43/0212 220/212

(Continued)

FOREIGN PATENT DOCUMENTS

JP 11-126649 A 5/1999
JP 3161783 U 7/2010
KR 10-1199690 B1 11/2012

OTHER PUBLICATIONS

ISA/KR, International Search Report for Int'l App. No. PCT/KR2014/009085, dated Nov. 17, 2014 (Korean and English translation).

(Continued)

*Primary Examiner* — James N Smalley

(57) ABSTRACT

A can cover having an inner cover comprising a circular groove in which an upper sealing portion of said can is inserted. An inner O-ring is tightly attached to said upper sealing portion of said can. Said inner O-ring is inserted into said circular groove of said inner cover. Also included is an outer coupling ring having a plurality of coupling protrusions inserted into a plurality of coupling grooves formed in an outer circumferential portion of said inner cover. A clearance is formed between said coupling grooves such that when said outer coupling ring is separated from said inner cover, said clearance spreads and separates said inner cover from said upper sealing portion of said can.

9 Claims, 11 Drawing Sheets

(56) References Cited

U.S. PATENT DOCUMENTS

| | | | | |
|---|---|---|---|---|
| 6,073,797 | A * | 6/2000 | Barous | B65D 17/165 215/387 |
| 6,155,452 | A * | 12/2000 | Laurent | B65D 81/3876 220/711 |
| 6,575,324 | B1 | 6/2003 | Hamer | |
| 7,306,111 | B2 | 12/2007 | Koslow | |
| 2004/0060935 | A1 * | 4/2004 | Perra | B65D 47/263 220/253 |

OTHER PUBLICATIONS

WIPO, International Preliminary Report on Patentability for Int'l App. No. PCT/KR2014/009085, dated Jul. 12, 2016 (Korean and English translation).

* cited by examiner

QUADRUPLE SEALING STRUCTURE FOR CAN COVER

CROSS REFERENCE TO RELATED APPLICATIONS

This application is a continuation-in-part of PCT Application No. PCT/KR2014/009085, filed on Sep. 29, 2014, which claims priority to Korea Application No. 10-2014-0002071, filed on Jan. 7, 2014, which are incorporated by reference in their entireties.

TECHNICAL FIELD

The present invention relates to a can cover, and more particularly, to a quadruple sealing structure for a can cover, which covers and seals an upper surface of a can to prevent contents stored in the can from leaking outside.

BACKGROUND

In general, as shown in a prior art beverage can as illustrated in FIG. 1A, a closure 2 is formed by a scored line 1 which has a deepness smaller than the thickness of an upper portion of a beverage can at one side of the upper surface of the can. A lever 3 is fixed to an upper central portion of the can. In this case, the scored line is not formed near the portion where the lever 3 is installed (that is, a portion near the upper central portion of the can at the circumference of the closure 2) so that one side of the closure 2 is not separated from the upper surface of the can. In addition, a tip of the lever 3 extends from one side of the closure 2 and is fixed to the one side of the closure 2.

Therefore, when a user holds a rear end of the lever 3 and then lifts up the lever 3, the tip of the lever 3 presses an upper surface of the closure 2 downward. As a result, the circumference of the closure 2 is cut out from the upper surface of the can along the scored line 1 and bent downward to form a discharge port (shown, for example, in FIG. 2A).

In the beverage cans having the above structure, the closure 2 is connected to the upper surface of the beverage can and is not separated from the upper surface of the beverage can even though the beverage can is opened. As a result, the beverage cans may be easily recycled and widely used.

However, once the closure 2 of such beverage can is opened, the opening cannot be closed and the beverage cannot be securely preserved. Therefore, in order to solve the above problem, as illustrated in FIG. 1B, an auxiliary closure for a beverage can, which has a quadruple sealing structure, is disclosed in Korean Patent No. 10-1199690 titled "Spare stopper with quadruple air tight structure for beverage can" filed on May 17, 2012.

FIG. 1B illustrates a bottom perspective view illustrating an auxiliary closure for a beverage can, according to the prior art.

Referring to FIGS. 1A and 1B, according to the prior art, the auxiliary closure for the beverage can in which the closure 2 is formed by a scored line at one side of an upper surface of the beverage can. The lever 3 is fixed onto the upper central portion, and an extending portion 4 having a narrowed diameter portion formed on an outer circumferential surface extends upward from an upper circumferential surface, and a concave groove 5 having a concave ring shape is formed downward so as to be positioned in the extending portion 4 such that when the closure 2 is pushed downward by using the lever 3, the circumferential surface of the closure 2 is cut out from the upper surface of the can to form a discharge port. The beverage can includes a support portion 6 having a wide circular plate shape, an outer extending end tube 7 (which extends downward from a lower circumferential surface of the support portion 6), a catching project 7*a* (which is caught by the narrowed diameter portion at an inner circumferential surface thereof), an inner extending end tube 8 (which has a smaller diameter than the outer extending end tube 7) extends downward to be concentric with the outer extending end tube 8 and has a lower end inserted into the concave groove 5, and a sealing member 9 (which is made of an elastic material) fixed at a lower side of a support portion 41 and seals the discharge port by being tightly attached to an upper surface around the discharge port.

However, the auxiliary closure in the prior art is configured to cover the upper surface of the beverage can so that the member 9 blocks the discharge port 2*a*. But only when the sealing member 9 is inserted between the lever 3 and the upper surface of the can, the discharge port may be securely blocked. In addition, when the upper surface of the can is covered without checking that the sealing member 9 is inserted between the lever 3 and the upper surface of the beverage can, a beverage leaks through the discharge port 2*a*.

Further, according to the prior art in Korean Patent No. 10-1199690, a spiral groove is formed on an outer surface of the outer extending end tube (an inner cap) and a sealed cover (an outer cap) is formed having a ring shape at the outside of the outer extending end tube. For example, when the outer cap (similar to a male spiral screw) slide down on the inner cap (similar to a female spiral screw), forces are exerted towards inner direction for squeezing the inner cap in order to air-tightly seal the upper side of the can. However, significant manual work is required for the spiral groove, and as a result, productivity is decreased. Thus, there remains a need for a beverage can with a new structure.

SUMMARY OF INVENTION

Accordingly the embodiments herein disclose a can cover including an inner cover. The inner cover includes a circular groove in which an upper sealing portion of the can is inserted. Further, the can cover includes an inner O-ring tightly attached to the upper sealing portion of the can, wherein the inner O-ring is inserted into the circular groove of the inner cover. Further, the can cover includes an outer coupling ring including a plurality of coupling protrusions inserted into a plurality of coupling grooves formed in an outer circumferential portion of the inner cover, wherein a clearance is formed between the coupling grooves such that when the outer coupling ring is separated from said inner cover, the clearance spreads and separates the inner cover from the upper sealing portion of the can.

In an embodiment, the circular groove of the inner cover includes an inner circumferential protruding portion and an outer circumferential protruding portion spaced apart with a distance d1.

In an embodiment, the distance d1 between the inner circumferential protruding portion and the outer circumferential protruding portion is greater than or equal to a thickness d2 of the upper sealing portion.

In an embodiment, the inner circumferential protruding portion and the outer circumferential protruding portion are tightly attached to an inner circumference and an outer circumference of the upper sealing portion to seal an upper surface of the can.

In an embodiment, the upper sealing portion of the can is inserted into the circular groove in a state to assemble the inner O-ring by inserting into the circular groove.

In an embodiment, the inner O-ring is tightly attached to an upper surface of the upper sealing portion such that left surface, right side surfaces, and the upper surface of the upper sealing portion of the can are tightly attached and sealed by the inner cover triply at three surfaces.

In an embodiment, a lower projection of the upper sealing portion is caught by an inner projection of the outer circumferential protruding portion to prevent the upper sealing portion from being withdrawn from the circular groove, such that the upper sealing portion is tightly attached to the circular groove, and a state in which the upper sealing portion of the can is inserted into the circular groove is maintained.

In an embodiment, at least one of the coupling grooves comprises a vertical coupling groove and a horizontal coupling groove, wherein the coupling protrusion of the outer coupling ring is inserted into the vertical coupling groove rotated at a portion where the vertical coupling groove is connected with the horizontal coupling groove and then coupled.

In an embodiment, wherein a length L1 of the horizontal coupling groove is ⅙ to 1/12 of the outer circumference of the inner cover.

In an embodiment, the horizontal coupling groove is formed such that a width thereof is decreased toward an end of the horizontal coupling groove.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE FIGURES

This invention is illustrated in the accompanying drawings, throughout which like reference letters indicate corresponding parts in the various figures. The embodiments herein will be better understood from the following description with reference to the drawings, in which.

DETAILED DESCRIPTION OF INVENTION

Figure 1A:
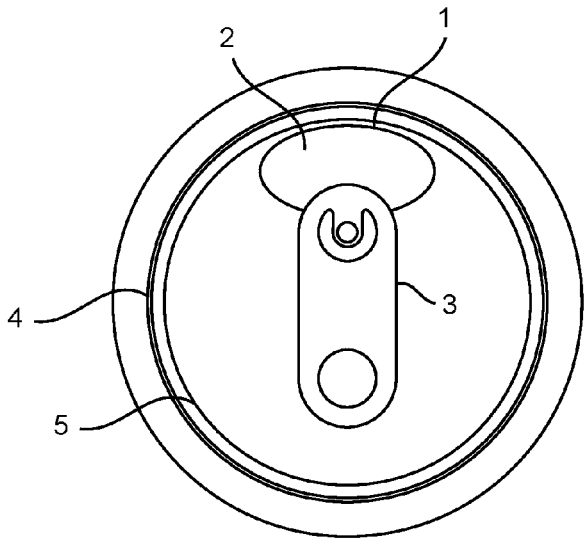
PRIOR ART FIG. 1A
FIG. 1A is a cross-sectional side view illustrating a beverage can, according to the prior art.
Figure 1B:
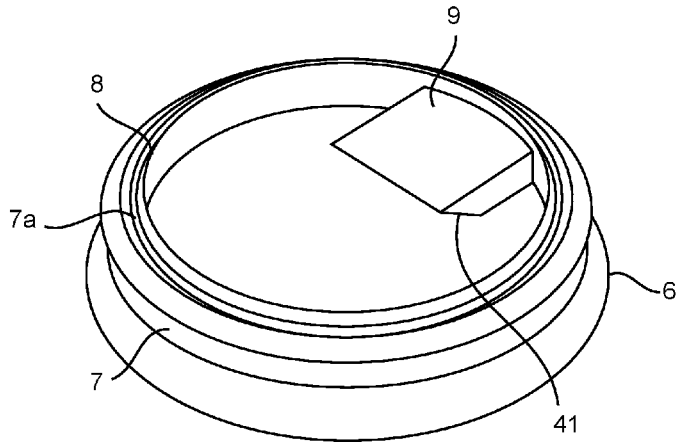
PRIOR ART FIG. 1B
FIG. 1B is a bottom perspective view illustrating the auxiliary closure for a beverage can, according to the prior art.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. Also, the various embodiments described herein are not necessarily mutually exclusive, as some embodiments can be combined with one or more other embodiments to form new embodiments. The term "or" as used herein, refers to a non-exclusive or, unless otherwise indicated. The examples used herein are intended merely to facilitate an understanding of ways in which the embodiments herein can be practiced and to further enable those skilled in the art to practice the embodiments herein. Accordingly, the examples should not be construed as limiting the scope of the embodiments herein.

The principal object of the embodiments herein is to provide a quadruple sealing structure for a can cover in which an upper surface of the can is sealed without using a sealing member, thereby making it possible to simplify the structure and reduce production costs.

Another object of the embodiments herein is to provide a quadruple sealing structure for a can cover in which an inner O-ring, made of a silicone resin, is inserted into a circular groove of the inner cover to which an upper sealing portion of the can is coupled, thereby making it possible to improve a tight contact property to prevent leakage of contents in the can.

Yet another object of the embodiments herein is to provide a quadruple sealing structure for a can cover in which the coupling protrusion of an outer coupling ring is inserted into the coupling groove of the inner cover to tighten an outer circumferential protruding portion, thereby making it possible to prevent the upper sealing portion of the can (which is inserted into the circular groove of the inner cover) from being withdrawn from the circular groove and to increase coupling force.

To achieve the objects, the embodiments herein disclose a can cover including an inner cover. The inner cover includes a circular groove in which an upper sealing portion of the can is inserted. Further, the can cover includes an inner O-ring tightly attached to the upper sealing portion of the can, wherein the inner O-ring is inserted into the circular groove of the inner cover. Further, the can cover includes an outer coupling ring including a plurality of coupling protrusions inserted into a plurality of coupling grooves formed in an outer circumferential portion of the inner cover, wherein a clearance is formed between the coupling grooves such that when the outer coupling ring is separated from said inner cover, the clearance spreads and separates the inner cover from the upper sealing portion of the can.

In an embodiment, the circular groove of the inner cover includes an inner circumferential protruding portion and an outer circumferential protruding portion spaced apart with a distance d1.

In an embodiment, the distance d1 between the inner circumferential protruding portion and the outer circumferential protruding portion is greater than or equal to a thickness d2 of the upper sealing portion.

In an embodiment, the inner circumferential protruding portion and the outer circumferential protruding portion are tightly attached to an inner circumference and an outer circumference of the upper sealing portion to seal an upper surface of the can.

In an embodiment, the upper sealing portion of the can is inserted into the circular groove in a state to assemble the inner O-ring by inserting into the circular groove.

In an embodiment, the inner O-ring is tightly attached to an upper surface of the upper sealing portion such that left surface, right side surfaces, and the upper surface of the upper sealing portion of the can are tightly attached and sealed by the inner cover triply at three surfaces.

In an embodiment, a lower projection of the upper sealing portion is caught by an inner projection of the outer circumferential protruding portion to prevent the upper sealing portion from being withdrawn from the circular groove, such that the upper sealing portion is tightly attached to the circular groove, and a state in which the upper sealing portion of the can is inserted into the circular groove is maintained.

In an embodiment, at least one of the coupling grooves comprises a vertical coupling groove and a horizontal coupling groove, wherein the coupling protrusion of the outer coupling ring is inserted into the vertical coupling groove rotated at a portion where the vertical coupling groove is connected with the horizontal coupling groove and then coupled.

In an embodiment, wherein a length L1 of the horizontal coupling groove is ⅙ to 1/12 of the outer circumference of the inner cover.

In an embodiment, the horizontal coupling groove is formed such that a width thereof is decreased toward an end of the horizontal coupling groove.

Unlike the conventional cans, the inner cover may have a coupling groove having a reverted L-shape ("⌐") at a circumference thereof. The coupling groove may include a vertical coupling groove and a horizontal coupling groove. The coupling protrusion of the outer coupling ring is inserted into the vertical coupling groove rotated at a portion where the vertical coupling groove is connected with the horizontal coupling groove, and then inserted into and coupled to the horizontal coupling groove while sliding along the horizontal coupling groove. In an embodiment, the height h2 of the vertical coupling groove may be shorter than a height h1 of the inner cover, and a length L1 of the horizontal coupling groove may be approximately ⅙ to 1/12 of the outer circumference of the inner cover. In an embodiment, the horizontal coupling groove may be formed such that a width thereof is decreased towards the end of the horizontal coupling groove, such that the coupling protrusion is securely tightened by the width of the horizontal coupling groove. As a result, the horizontal coupling groove is securely coupled to the coupling protrusion.

Further, the left side surface, right side surfaces and the upper surface of the upper sealing portion of the can are tightly attached to the inner cover at three surfaces, thereby maintaining a sealed state of the upper surface of the can. In addition, the upper surface of the can is sealed without using a sealing member that covers a discharge portion of the can, thereby simplifying a structure and reducing production costs. Moreover, the outer circumference of the inner cover is tightened by the outer coupling ring, which is coupled by the coupling groove instead of a screw structure such that the upper sealing portion of the can (which is inserted into the circular groove of the inner cover) is prevented from being withdrawn from the circular groove, thereby increasing coupling force.

Referring now to the drawings and more particularly to FIGS. 2A through 6B, where similar reference characters denote corresponding features consistently throughout the figures, there are shown preferred embodiments.

Figure 2A:
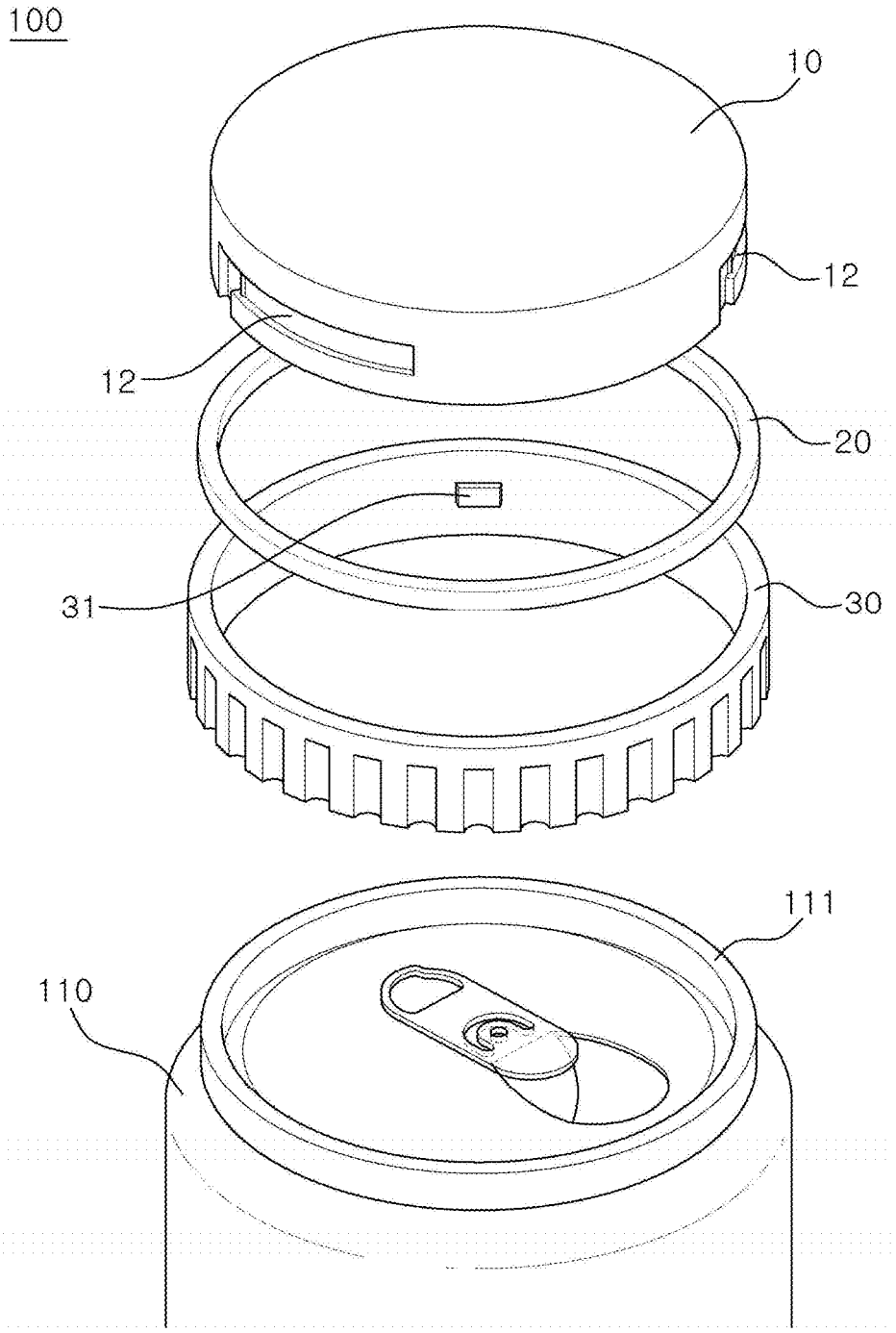
FIG. 2A is an exploded perspective view illustrating a configuration of a quadruple sealing structure for a can cover, according to the embodiments disclosed herein.
Figure 2B:
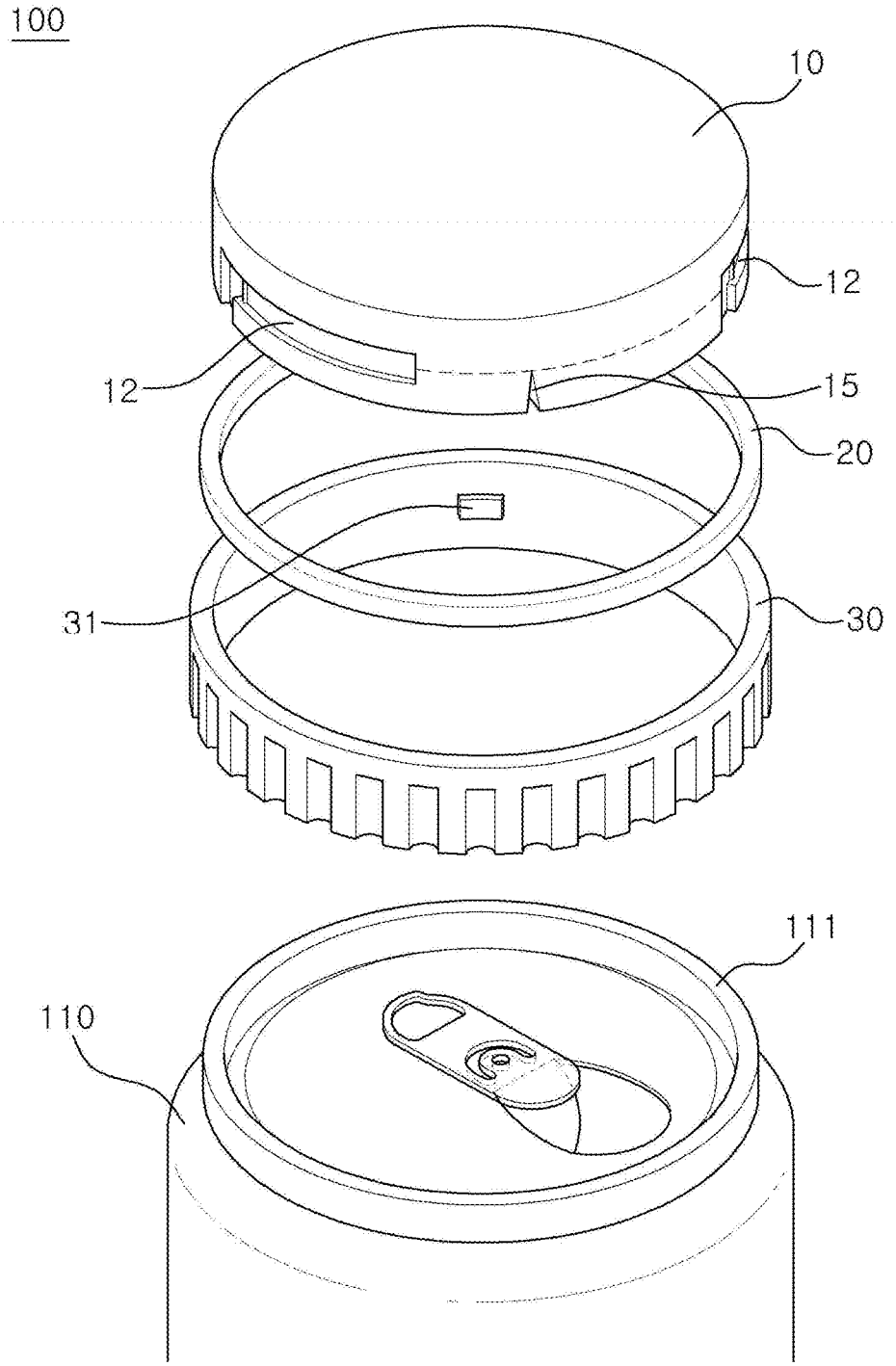
FIG. 2B is an exploded perspective view thereof in which a clearance is formed in an inner cover of the quadruple sealing structure for the can cover, according to the embodiments disclosed herein.
Figure 2C:
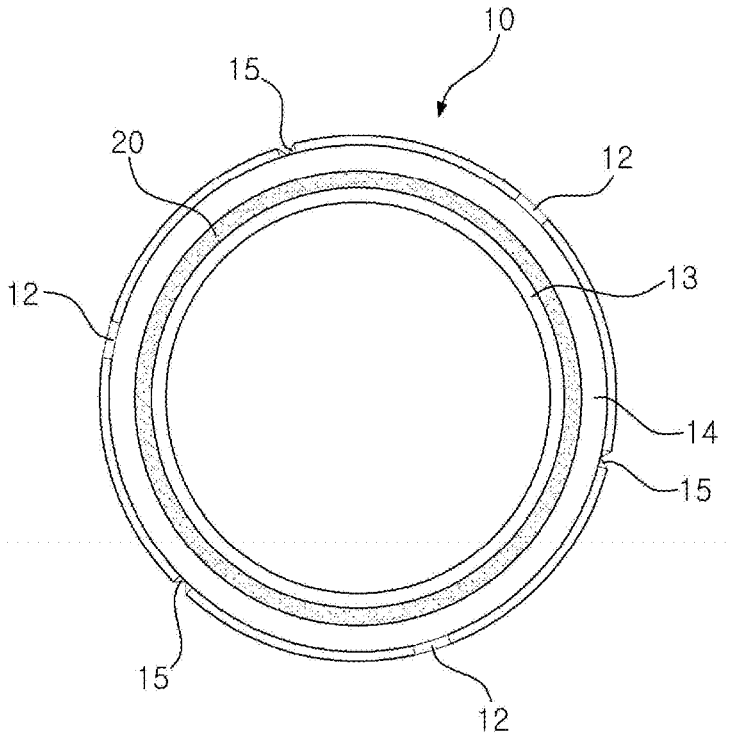
FIG. 2C is a bottom plan view thereof in which a clearance is formed in the inner cover that constitutes the can cover, according to the embodiments disclosed herein.
Figure 3A:
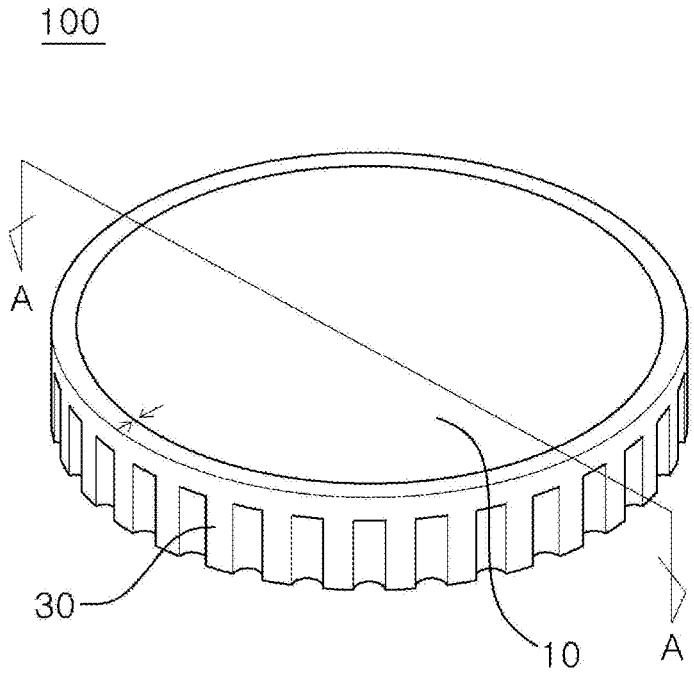
FIG. 3A is a perspective view illustrating a state in which the can cover is assembled, according to the embodiments disclosed herein.
Figure 3B:
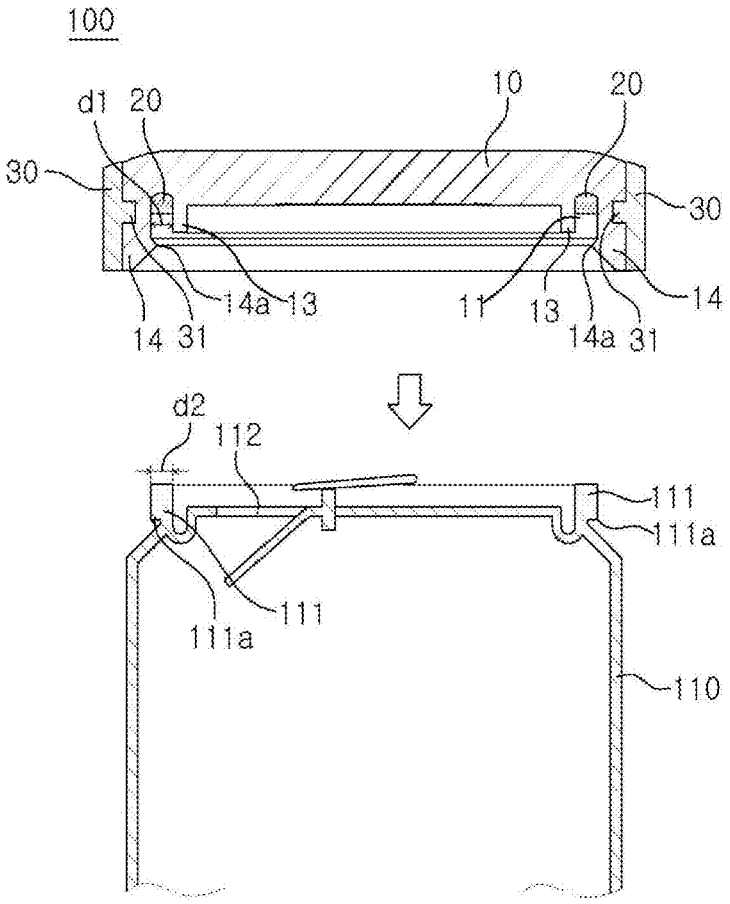
FIG. 3B is a cross-sectional view taken along line A-A that runs through a center of the can cover showing the can cover and can separately, according to the embodiments disclosed herein.

FIG. 2A is an exploded perspective view illustrating a configuration of a quadruple sealing structure for a can cover, according to the embodiments disclosed herein. FIG. 2B is an exploded perspective view thereof in which a clearance is formed in an inner cover of the quadruple sealing structure for the can cover, according to the embodiments disclosed herein. FIG. 2C is a bottom plan view illustrating the inner cover that constitutes the can cover, according to the embodiments disclosed herein. Moreover, FIG. 3A is a perspective view illustrating a state in which the quadruple sealing structure for the can cover is assembled according to the embodiments disclosed herein, and FIG. 3B is a cross-sectional view taken along line A-A that runs through a center of the quadruple sealing structure for the can cover according to the embodiments disclosed herein.

In an embodiment, a quadruple sealing structure 100 for a can cover includes: an inner cover 10 which has a circular groove 11 in which an upper sealing portion 111 formed at an upper end portion of a can 110 is inserted and covers an upper surface of the can 110; an inner O-ring 20 which is inserted into the circular groove 11 of the inner cover 10 and is tightly attached to the upper sealing portion 111 of the can 110; and an outer coupling ring 30 which has a plurality of coupling protrusions 31 inserted into a plurality of coupling grooves 12 formed in an outer circumferential portion of the inner cover 10.

In an embodiment, the inner cover 10 has the circular groove 11, which is opened at a lower side thereof so that the upper sealing portion 111 (formed at the upper end portion of the can 110) is inserted into the circular groove 11. In an embodiment, the inner cover 10 may be made of a synthetic resin such as polypropylene.

The circular groove 11 is formed concentrically with the upper sealing portion 111 of the can 110 such that when the upper surface of the can 110 is covered by the inner cover 10, the upper sealing portion 111 is inserted into and is tightly attached to the circular groove 11.

In an exemplary embodiment, as illustrated in the FIGS. 2B and 2C, clearances 15 may be formed among the coupling grooves 12, respectively. Therefore, when the outer coupling ring 30 is separated from the inner cover 10 (for example, three clearances 15 are spread). As a result, the inner cover 10 may be easily separated from the upper sealing portion 111 of the can 110. In addition, in case if gas is produced from contents in the can 10 and gas pressure is applied inside the inner cover 10, the clearances 15 are spread and gas leaks thereby eliminating the gas pressure. In this case, it is possible to prevent the contents from spurting due to the gas when the inner cover 10 is separated from the can 110.

Figure 4:
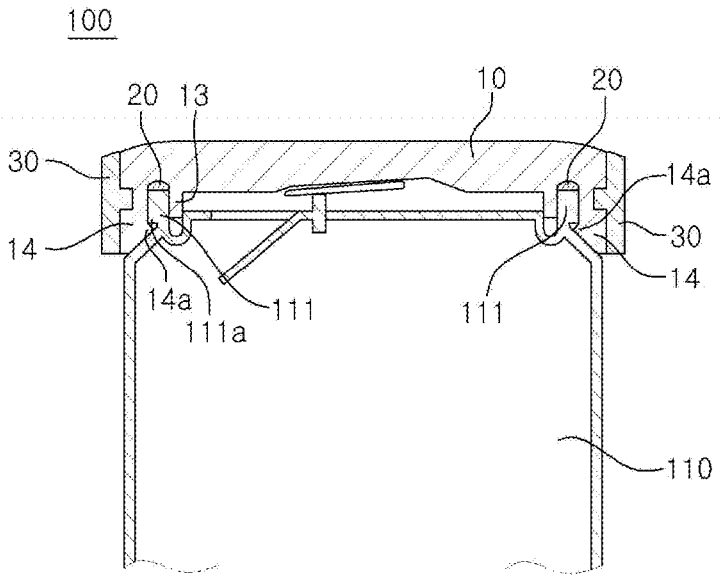
FIG. 4 is a cross-sectional view taken along line A-A that runs through a center of a can in a state in which the quadruple sealing structure for the can cover is engaged with the can, according to the embodiments disclosed herein.

FIG. 4 is a cross-sectional view taken along line A-A which runs through a center of a can in a state in which the quadruple sealing structure for the can, according to embodiments as disclosed herein.

In an embodiment, the inner O-ring 20 is inserted into the circular groove 11 before the upper sealing portion 111 of the can 110 is inserted into the circular groove 11. Thereafter, when the upper sealing portion 111 is inserted into the circular groove 11, an upper surface of the upper sealing portion 111 is tightly attached to the inner O-ring 20; and left side surfaces, right side surfaces, and the upper surface of the upper sealing portion 111 of the can 110 are tightly attached to the inner cover 10 triply at three surfaces, thereby sealing the upper surface of the can 110.

In an embodiment, the inner O-ring 20 may be made of a silicone resin or the like, and at least has a cross section having a quadrangular shape having a rounded upper surface, and may be assembled by being inserted into the circular groove 11. Therefore, when the upper sealing portion 111 of the can 110 is inserted into the circular groove 11, the inner O-ring 20 is tightly attached to the upper surface of the upper sealing portion 111 thereby sealing the upper surface of the can 110.

Figure 6A:
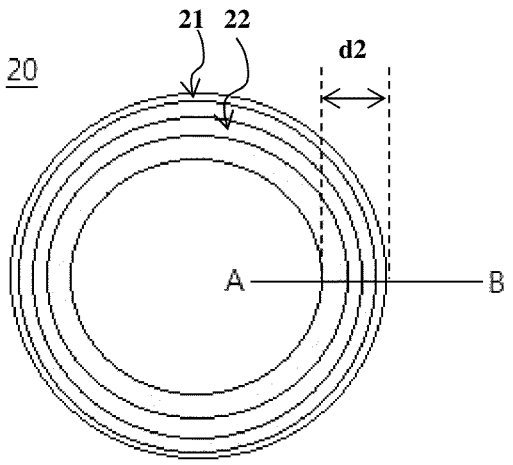
FIG. 6A is a cross-sectional view of the can cover of the present invention.
Figure 6B:
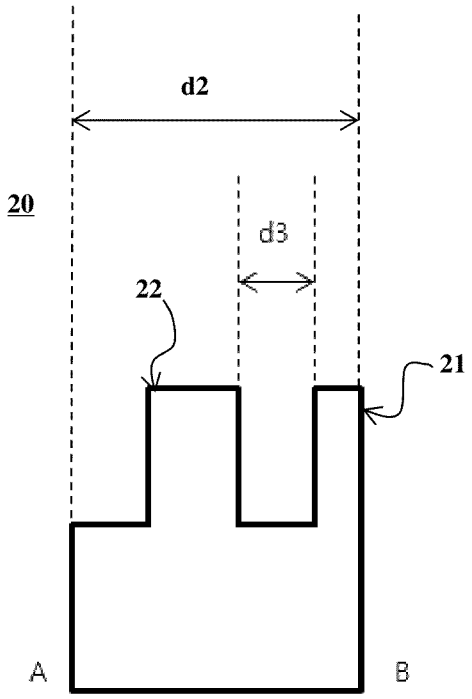
FIG. 6B is a cross-sectional view of the can cover of FIG. 6A across the cross-section denoted "A-B" in FIG. 6A.

In an embodiment, the inner O-ring 20 may include a plurality of protrusions. In FIGS. 6A and 6B, the inner O-ring 20 includes inner protrusion 21 and outer protrusion 22. Therefore, the protrusions 21 and 22 help the inner O-ring 20 to be more tightly attached to the upper surface of the upper sealing portion 111 thereby sealing the upper surface of the can 110.

In addition, the circular groove 11 of the inner cover 10 includes an inner circumferential protruding portion 13 and an outer circumferential protruding portion 14. In this case, an interval d1 between the inner circumferential protruding portion 13 and the outer circumferential protruding portion 14 is equal to or slightly larger than a thickness d2 of the upper sealing portion 111 such that when the upper sealing portion 111 of the can 110 is inserted into the circular groove 11, an inner circumference and an outer circumference of the upper sealing portion 111 may be tightly attached and sealed by the inner circumferential protruding portion 13 and the outer circumferential protruding portion 14.

In this case, a lower projection 111*a* of the upper sealing portion 111 is caught by an inner projection 14*a* of the outer circumferential protruding portion 14, thereby preventing the upper sealing portion 111 from being withdrawn from the circular groove 11. In addition, it is possible to maintain a state in which the upper sealing portion 111 is tightly attached to and inserted into the circular groove 11.

Further, the state in which the upper sealing portion 111 is inserted into the circular groove 11 is maintained. As the lower projection 111*a* of the upper sealing portion 111 is caught by the inner projection 14*a*, the inner O-ring 20 is tightly attached to the upper sealing portion 111 by being pressed by the upper sealing portion 111. For example, when the inner projection 14*a* is in contact with the lower projection 111*a*, the lower projection 111*a* pushes the inner projection 14*a* and the upper sealing portion 111 pushes the O-ring 20 simultaneously. Therefore, the O-ring 20 can seal the upper side of the can.

Therefore, liquid stored in the can 110 does not leak even though the liquid flows out of an outlet 112. Therefore, the left and right side surfaces and the upper surface of the upper sealing portion 111 of the can 110 are tightly attached to the inner cover 10 triply at three surfaces. As a result, the upper surface of the can 110 is sealed and is blocked from being communication leaking the liquid outside, thereby maintaining a sealed state.

However, in an embodiment, the quadruple sealing structure 100 for the can cover is not limited to the triple sealing, and may also provide quadruple sealing or the like that tightens an outer circumference of the inner cover 10 with the outer coupling ring 30.

Figure 5A:
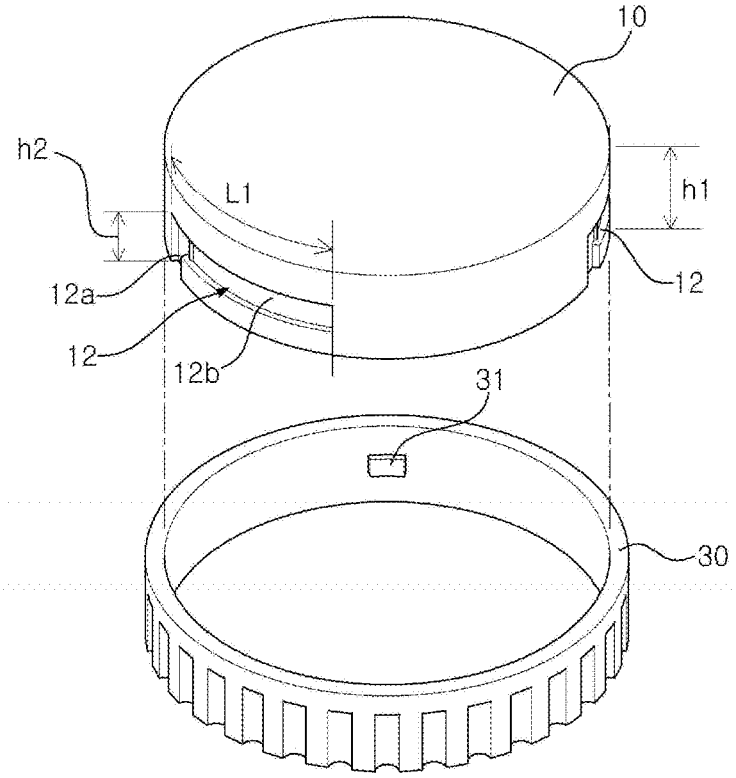
FIG. 5A is a perspective view illustrating a state in which the inner cover and an outer coupling ring are separated, according to an embodiment disclosed herein.
Figure 5B:
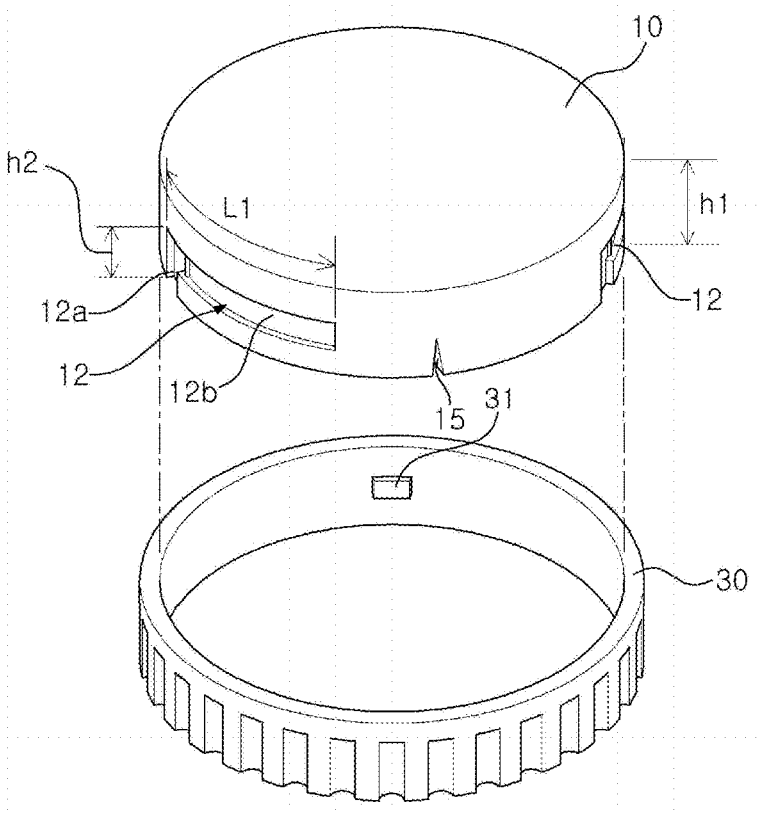
FIG. 5B is a perspective view illustrating a state in which the inner cover and an outer coupling ring are separated, according to the embodiment disclosed herein and shown in FIGS. 2B and 2C.

FIG. 5A is a perspective view illustrating a state in which the inner cover and the outer coupling ring are separated, according to embodiments as disclosed herein. FIG. 5B is a perspective view illustrating a state in which an inner cover, which has a clearance according is separated from the outer coupling ring, according to embodiments as disclosed herein.

In an embodiment, the inner cover 10 has the coupling groove 12 that is formed in the outer circumference of the inner cover 10 and has a reverted L-shape ("⌐-"). The coupling groove 12 may include a vertical coupling groove 12*a* and a horizontal coupling groove 12*b*. Height h2 of the vertical coupling groove 12*a* may be, for example, about ⅔ of a height h1 of the inner cover 10. Length L1 of the horizontal coupling groove 12*b* may be, for example, about ⅙ of the outer circumference of the inner cover 10.

The length L1 of the horizontal coupling groove 12*b* is determined depending on the number of coupling grooves 12. In the present exemplary embodiment, three coupling grooves 12 are formed to form an angle of 120° therebetween such that the three coupling grooves 12 are formed at points defined by dividing the outer circumference of the inner cover 10 into three equal parts. The length L1 of the horizontal coupling groove 12*b* may be set to a length corresponding to ⅙ of the outer circumference of the inner cover 10 which is made by dividing ⅓ of the outer circumference of the inner cover 10 into two equal parts.

More coupling grooves 12 would yield a higher coupling force between the inner cover 10 and the outer coupling ring 30. However, because the length L1 of the horizontal coupling groove 12*b* is shortened, it may be difficult to simultaneously couple the plurality of coupling protrusions 31 to the plurality of coupling grooves 12. Therefore, for example, the number of coupling grooves 12 is determined in a range in which the length L1 of the horizontal coupling groove 12*b* is not too short, and the coupling force between the inner cover 10 and the outer coupling ring 30 is strong (for example, in a range from three to six).

In an embodiment, the outer coupling ring 30 is made of an ABS resin or the like. The coupling protrusion 31 of the outer coupling ring 30 is inserted into the vertical coupling groove 12*a*, rotated counterclockwise at a portion where the vertical coupling groove 12*a* is connected with the horizontal coupling groove 12*b*, and then inserted into the horizontal coupling groove 12*b* while sliding along the horizontal coupling groove 12*b*. In this case, when the coupling protrusion 31 is rotated by the length L1 of the horizontal coupling groove 12*b* and then reaches the other end of the horizontal coupling groove 12*b*, the outer coupling ring 30 is completely coupled.

With the outer coupling ring 30, the outer circumferential protruding portion 14 of the inner cover 10 is tightened. As a result, it is possible to prevent the upper sealing portion 111 of the can 110, which is inserted into the circular groove 11 of the inner cover 10, from being withdrawn from the circular groove 11, thereby increasing coupling force.

The number of coupling protrusions 31 of the outer coupling ring 30 may be equal to the number of coupling grooves 12 of the inner cover 10. However, the number of coupling protrusions 31 may be smaller than the number of coupling grooves 12. But the number of coupling protrusions 31 may be at least two so that the inner cover 10 and the outer coupling ring 30 are coupled to each other at two or more points.

In addition, the horizontal coupling groove 12*b* is formed such that a width thereof is decreased toward the end of the horizontal coupling groove 12*b*, such that the coupling protrusion 31 is securely tightened by the width of the horizontal coupling groove 12*b*. As a result, the horizontal coupling groove 12*b* is securely coupled to the coupling protrusion 31.

In addition, as illustrated in the FIG. 5B, one or more clearances 15 may be formed between the coupling grooves 12 to the middle of the horizontal coupling groove 12*b*. In this case, when the inner cover 10 is tightened by the outer coupling ring 30, the clearance 15 becomes narrow. Therefore, it is possible to prevent the upper sealing portion 111 of the can 110, which is inserted into the circular groove 11 of the inner cover 10, from being withdrawn from the circular groove 11, thereby further increasing coupling force. When the outer coupling ring 30 is separated from the inner cover 10, the clearance 15 is spread again. In this case, even though the inside of the inner cover 10 is filled with gas, it is possible to prevent the contents from explosively spurting due to a gas leak when the inner cover 10 is separated from the can 110.

The present invention is not limited to the above specific preferred exemplary embodiments, the exemplary embodiments may be variously modified by those skilled in the art to which the present invention pertains without departing from the subject matters of the present invention claimed in the claims, and the modifications belong to the scope disclosed in the claims.

The foregoing description of the specific embodiments will so fully reveal the general nature of the embodiments herein that others can, by applying current knowledge, readily modify or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the technical spirit and scope of the embodiments as described herein.

What is claimed is:

1. A can cover comprising:

an inner cover comprising a circular groove;

an inner O-ring inserted into said circular groove of said inner cover, wherein an upper sealing portion of said can is inserted into said circular groove of said inner cover such that said inner O-ring is tightly attached to said upper sealing portion of said can; and an outer coupling ring comprising a plurality of coupling protrusions inserted into a plurality of coupling grooves formed in an outer circumferential portion of said inner cover;

wherein a clearance is formed between said coupling grooves such that when said outer coupling ring is separated from said inner cover, said clearance spreads and separates said inner cover from said upper sealing portion of said can; and wherein at least one of said coupling grooves comprises a vertical coupling groove and a horizontal coupling groove, wherein said coupling protrusion of said outer coupling ring is inserted into said vertical coupling groove rotated at a portion where said vertical coupling groove is connected with said horizontal coupling groove and then coupled.

2. The can cover of claim 1, wherein said circular groove of said inner cover includes an inner circumferential protruding portion and an outer circumferential protruding portion spaced apart with a distance d1.

3. The can cover of claim 2, wherein said distance d1 between said inner circumferential protruding portion and said outer circumferential protruding portion is greater than or equal to a thickness d2 of said upper sealing portion.

4. The can cover of claim 2, wherein said inner circumferential protruding portion and said outer circumferential protruding portion are tightly attached to an inner circumference and an outer circumference of said upper sealing portion to seal an upper surface of said can.

5. The can cover of claim 1, wherein said upper sealing portion of said can is inserted into said circular groove in a state to assemble said inner O-ring by inserting into said circular groove.

6. The can cover of claim 5, wherein said inner O-ring is tightly attached to an upper surface of said upper sealing portion such that left surface, right side surfaces, and said upper surface of said upper sealing portion of said can are tightly attached and sealed by said inner cover triply at three surfaces.

7. The can cover of claim 2, wherein a lower projection of said upper sealing portion is caught by an inner projection of said outer circumferential protruding portion to prevent said upper sealing portion from being withdrawn from said circular groove, such that the upper sealing portion is tightly attached to said circular groove, and a state in which said upper sealing portion of said can is inserted into said circular groove is maintained.

8. The can cover of claim 1, wherein a length L1 of said horizontal coupling groove is approximately ⅙ to 1/12 of said outer circumference of said inner cover.

9. The can cover of claim 1, wherein said horizontal coupling groove is formed such that a width thereof is decreased toward an end of said horizontal coupling groove.

* * * * *